United States Patent [19]

Sjögren

[11] Patent Number: 5,018,618

[45] Date of Patent: May 28, 1991

[54] DEVICE FOR TEMPORARILY STORING A SUCCESSION OF NEWSPAPERS

[75] Inventor: Rolf Sjögren, Eksjö , Sweden

[73] Assignee: Wamac AB, Sweden

[21] Appl. No.: 400,497

[22] Filed: Aug. 30, 1989

[30] Foreign Application Priority Data

Sep. 15, 1988 [SE] Sweden ..... 8803254

[51] Int. Cl.[5] ..... B65G 37/00

[52] U.S. Cl. ..... 198/347.3; 414/331

[58] Field of Search ..... 414/331, 458; 198/347.3

[56] References Cited

U.S. PATENT DOCUMENTS

| | | | |
|---|---|---|---|
| 3,754,632 | 8/1973 | Kreutter | 198/347 |
| 4,170,285 | 10/1979 | Hinchcliffe | 198/347 |
| 4,499,987 | 2/1985 | Long | 198/347 |
| 4,712,361 | 12/1987 | Oberoi | 414/793.7 X |

FOREIGN PATENT DOCUMENTS

| | | | |
|---|---|---|---|
| 2254260 | 5/1974 | Fed. Rep. of Germany | 198/347 |
| 2636163 | 2/1977 | Fed. Rep. of Germany | 198/347 |
| 2640867 | 3/1977 | Fed. Rep. of Germany | 198/347 |
| 0235129 | 10/1987 | Japan | 414/222 |
| 2061216 | 5/1981 | United Kingdom | 198/347 |

OTHER PUBLICATIONS

Wafer Buffer, IBM Technical Disclosure Bulletin, Hansom et al., 4–1976.

*Primary Examiner*—Robert J. Spar
*Assistant Examiner*—John Vanden Bosche
*Attorney, Agent, or Firm*—Ostrolenk, Faber, Gerb & Soffen

[57] ABSTRACT

A method of achieving temporary storage of a succession of objects such as newspapers, arranged in overlapping formation, comprising dividing the succession of objects into sections (1) carried along on a conveyor (22) to a position close to a series of vertically displaceable shelves (21), depositing the sections (1) on the shelves and displacing the series of shelves transversely to the direction of movement of the conveyor in order to bring the shelves into a position close to the conveyor to allow the sections to be deposited on the shelves or to be transferred from the shelves to the conveyor when the temporarily stored sections are to be fed out. An apparatus for performing the method comprises a mechanism (10) for dividing the succession of objects into sections, a conveyor (22) for transporting the sections (1) through a temporary store consisting of a series of shelves (21), and a mechanism (20', 22, 23, 25, 26) for transferring the sections between shelves and conveyor.

7 Claims, 2 Drawing Sheets

DEVICE FOR TEMPORARILY STORING A SUCCESSION OF NEWSPAPERS

Figure 1:
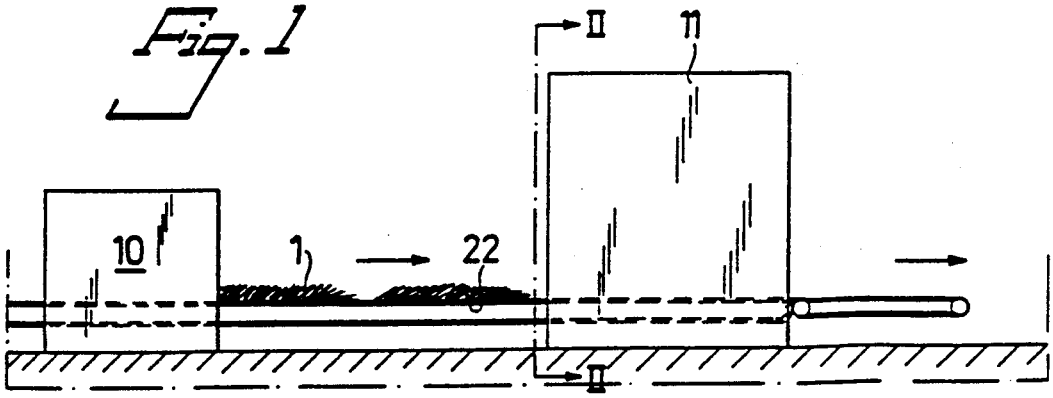

The present invention relates to a method and means for achieving temporary storage of a succession of objects such as newspapers, arranged in overlapping formation, as described in the preamble to the appended method claim and apparatus claim, respectively.

In newspaper printing plants, for instance, there are numerous occasions when it is necessary to temporarily store a succession of newspapers arranged in overlapping formation before they continue through the plant. For practical reasons the succession of newspapers is suitably temporarily stored with overlap between individual newspapers. However, this causes certain problems since another condition is that the newspapers must leave the temporary storage place aligned in the same direction as when they entered.

In a method known per se temporary storage is arranged in the form of a helical ramp with vertical shaft, a succession of newspapers being caused to run up the ramp for temporary storage. However, it will readily be understood that the individual newspapers will be turned in relation to each other, involving the risk of creasing and of the printing ink becoming smudged, as well as a risk of the newspapers being incorrectly aligned after withdrawal.

According to another known method, more frequently used, a drum is used onto which a succession of newspapers is rolled with the aid of a strap. This method also has a number of drawbacks and limitations. The tension in the strap must be adjusted to the number of pages in each newspaper, for instance, as well as to the print to ensure that no creasing or smudging occurs, and in the case of thin newspapers the strap tension must be reduced with the result that the drum capacity is considerably reduced. Rolling the newspapers also has the drawback that the capacity is dependent on the flow of newspapers being symmetrical along the longitudinal axis. If there is a side edge along one longitudinal edge, for instance, the roll will become higher on that side, thus limiting the storage capacity of the drum.

Several drums or rolls are also required, and these must be transported by various transport means in an environment where floor space is at a premium. The drum method also has the disadvantage that when the newspapers are withdrawn from the magazine they will be running in a direction opposite to that in which they were rolled. Additional apparatus is therefore required—entailing additional cost—if the newspapers are to be dealt with in the "normal" manner as when they pass directly from the printing press and on through the production line.

One object of the invention is thus to achieve a temporary storage method which requires little space, is uncomplicated and, with simple means and high capacity, offers temporary storage of a succession of objects arranged in overlapping formation in such a way that they can be removed from the magazine in the same direction and with the same overlapping formation as when they entered.

Other objects and advantages of the invention will be revealed in the following.

The method according to the invention is defined in the appended method claim. Modifications of the method are defined in the dependent claims.

The apparatus according to the invention is defined in the appended appratus claim and embodiments of the apparatus are defined in the dependent claims.

The temporary storage method thus substantially comprises dividing the succession of objects/newspapers into longitudinal sections which are carried along on a conveyor to a position close to a series of shelves, depositing the sections on the shelves and displacing the series of shelves transversely to the direction of movement of the conveyor in order to bring the shelves into a position close to the conveyor to allow the sections to be deposited on the shelves or to be transferred from the shelves to the conveyor when the temporarily stored sections are to be fed out.

According to one embodiment the sections may be carried along the conveyor to a position between two parallel series of shelves, so as to bridge adjacent, opposing shelves, the sections being deposited on the shelves or transferred from the shelves to the conveyor by both series of shelves being synchronously displaced in vertical direction. In the embodiment with two series of shelves the shelves are suitably arranged in pairs to form skid rails for edge sections of the section being transported on the conveyor. The shelves cooperating with the section on the conveyor are suitably inclined in relation to shelves above in the series, in order to increase the distance thereto, thus reducing the risk of individual newspapers becoming caught up when entering or leaving the temporary storage.

An important feature of the method claimed is thus that the substantially continuous succession of overlapping newspapers or the like leaving the printing press is initially divided into longitudinal sections, the length of which corresponds substantially to the length of said shelves. The devices and arrangements used to divide the succession of newspapers into sections are known per se and commercially available. They will not therefore be further described.

In principle the sections need only be separated enough in longitudinal direction to allow a section to be lifted or lowered without disturbing adjacent sections.

The apparatus according to the invention substantially comprises means for dividing the succession of objects into sections, a conveyor for transporting the sections through a store consisting of a series of shelves, means for transferring the sections between shelves and conveyor, and devices for moving the shelves in the series past the conveyor transversely to its longitudinal direction. The transfer means may comprise a second series of shelves, the two series being located one on each side of the conveyor, enabling them to raise or lower a section from or onto said conveyor via the two long edges of the section. In this case the two series of shelves are suitably arranged with parallel shelves, the neighbouring edges of the shelves being close together allowing the section of newspapers to bridge the gap between them without falling through. The two series of shelves are suitably arranged to move in pairs and synchronously and the series are suitably arranged to extend and to be displaced in substantially vertical direction.

The shelves are suitably arranged to form skid rails for the edges of the sections carried on the conveyor.

The apparatus may also include means for increasing the space between the two shelves in the series located nearest above and below the support surface of the conveyor, with a view to reducing the risk of individual newspapers becoming caught in the equipment when entering or leaving the temporary store.

The series of shelves are suitably arranged on continuous chains running over horizontal shafts arranged vertically one above the other. In the embodiment with two series of shelves, therefore, both series are driven by a common drive motor via a gear transmission, preferably in the form of a worm gear or the like which is self-inhibiting so that the series of shelves cannot descend freely.

The invention will be described in the following by way of example with reference to the accompanying drawings.

Figure 2:
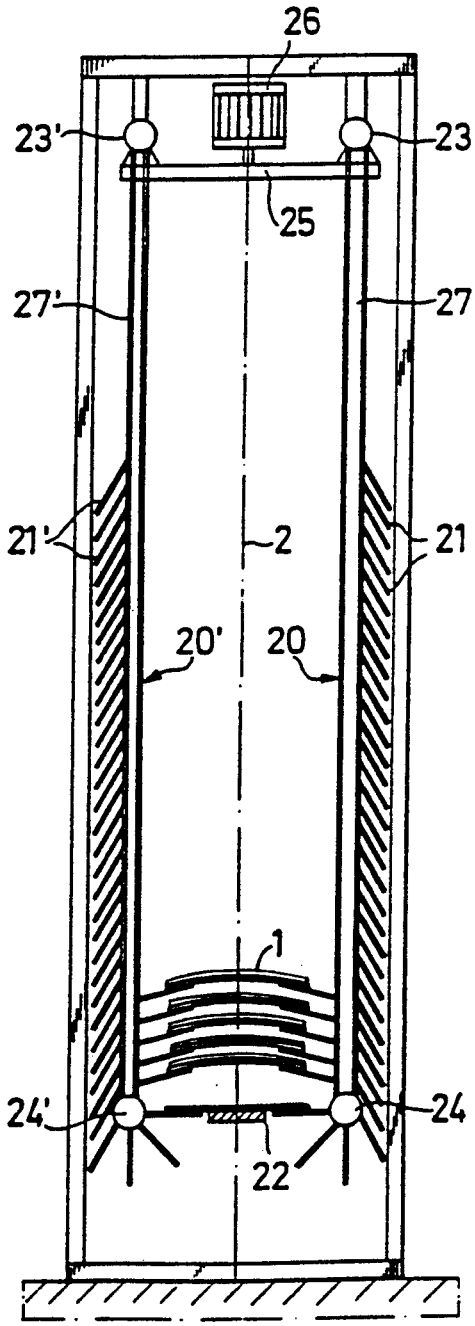
Figure 3:
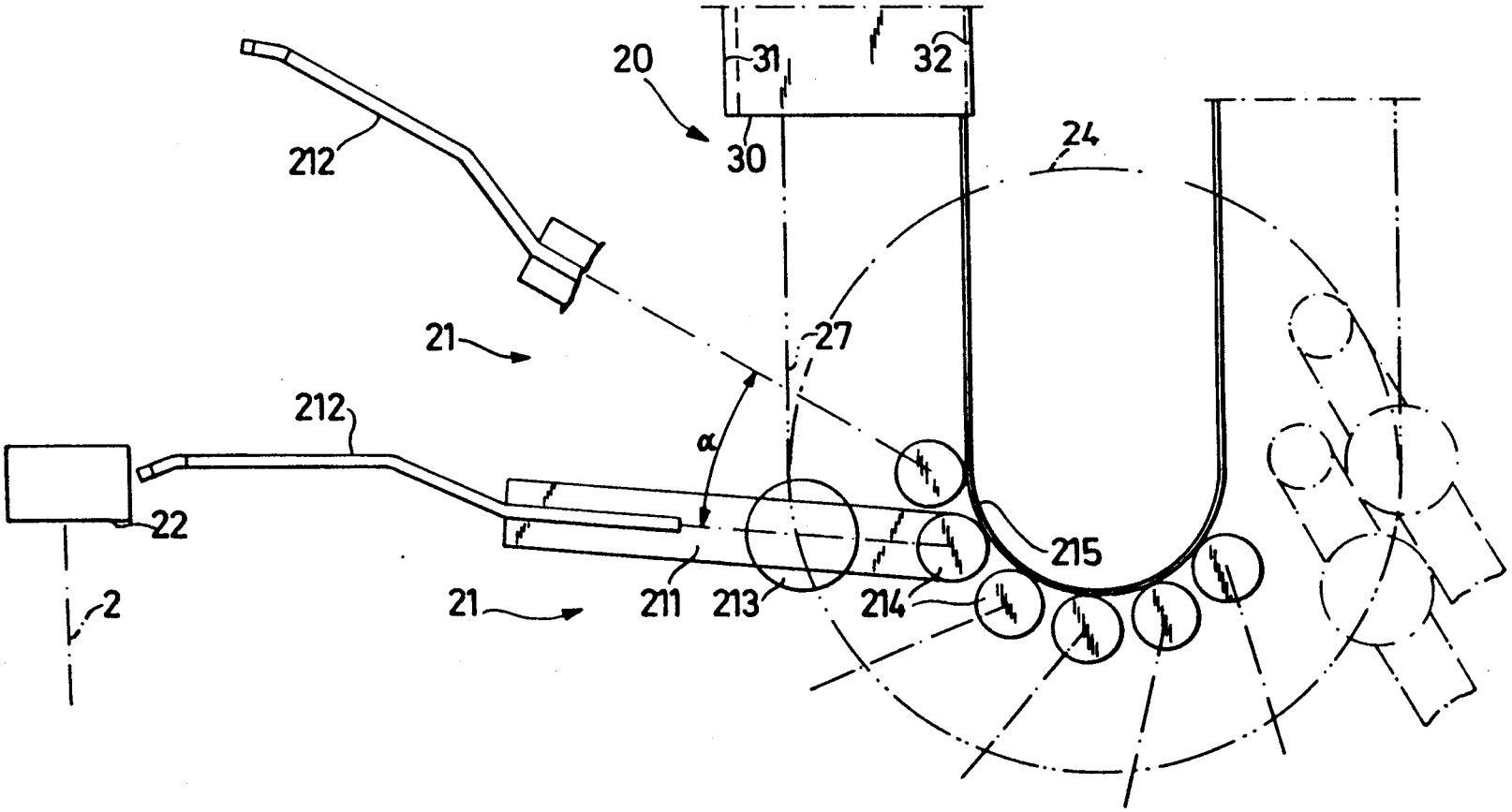

FIG. 1 shows schematically a side view of a temporary store according to the invention, FIG. 2 shows an end view taken along the line II—II in FIG. 1, and FIG. 3 shows schematically the principle embodiment of the lower, righthand part of the temporary store as shown in FIG. 2.

FIG. 1 shows schematically a conveyor 22 with means 10 known per se and commercially available, e.g. a deposit station for a gripper conveyor, by means of which a continuous succession of newspapers is divided into separate sections 1. These sections follow each other and are carried on the conveyor in the direction indicated by the arrow, into a schematically indicated temporary store 11 where a plurality of sections 1 can be temporarily stored and then fed out of the store 11 on the other side in the same direction, the newspapers in the sections retaining the same overlapping formation and alignment.

In FIG. 2 it can be seen that the conveyor 22 extends through the store 11, that the store 11 is substantially symmetrical about the plane of symmetry 2, and that the store comprises two sets 20 and 20' of shelves 21. The shelves 21 are arranged parallel to each other on a continuous chain 27 running over an upper deflection wheel 23 and a lower deflection wheel 24. The two series 20, 20' of shelves are driven by a common motor 26 which, via a gear means 25, drives the deflection wheels 23, 23'. The gear means 25 is a self-inhibiting worm gear. The two sets of shelves 20, 20' are arranged symmetrically and driven synchronously.

The sections 1 are divided in the separator 10 into lengths corresponding to the length of the shelves 21 in longitudinal direction of the conveyor 22. They run into the store 11 on the conveyor 22 until the section 1 is opposite the shelves 21. When a section 1 is fed into the store 11 guide means, not shown, are arranged to keep a pair of shelves 21 aligned towards each other and at substantially the same level as the conveyor 22. These shelves thus also serve as skid rails for the section 1 entering. Evidently the conveyor 22 must be narrow, allowing the shelves 21 in the two series 20, 20' to be located close to each other, thus supporting an overbridging section 1 without risk of the section falling down in the gap between the shelves when the shelves are raised from the conveyor 22.

One skilled in the art will appreciate that the chains 27 are driven stepwise in order to align each pair of shelves in turn opposite to the conveyor 22, whereupon a section of newspapers previously received on a pair of shelves 21 is raised in the space between the two series 20, 20' of shelves, and a new section 1 can be inserted into the temporary store. The control equipment required for carrying out the method described can be constructed by anyone familiar with the art and therefore requires no further explanation.

In principle shelves 21 are only required along one part of each chain 27, 27'.

As is also clear from FIG. 2, the conveyor 22 is located in the region of the lower deflection wheel 24 for the chains 27. The advantage is thus obtained that, as shown in the figure, the movement of the shelves as they turn around the deflection wheel provides a relatively large space between vertically neighbouring shelves when the sections 1 are being fed in or out.

As can be seen in FIG. 1, the store 11 is of through-passage type.

The plane of symmetry 2 and the conveyor 22 are recognizable in FIG. 3. A shelf 21 can also be seen forming a support, and a skid rail 212 which may consist of an explosion-extruded aluminium section secured in a base 211. The base 211 is fitted via a roller 213 into the schematically shown chain 27 running around the wheel 24, also shown schematically. The base 211 is in the form of an arm or rail and is provided at its inner end with a roller 214 which follows a cam surface 215 at the lower curve of the chain 27. The cam mechanism formed by roller 214 and cam 215 provides accurate alignment of the rail 212 in relation to the conveyor 22. As seen in FIG. 3, the shelf 21 is inclined obliquely upwardly by the roller 214 and the cam 215. The desired angle $\alpha$ for a shelf 21 is thus also obtained when this is raised one step up from the position in which it receives a newspaper section from the conveyor 22.

As is seen in FIG. 3, a relatively large space is offered between the shelves 21 receiving a section from the conveyor 22 and the shelf 21 immediately above.

In the vertical portions of the chains 27, 27' the shelves 21 are parallel and the distance between them corresponds to the expected thickness of the thickest newspaper section to be received.

A guide casing 30 is also shown in FIG. 3, extending along substantially the entire vertical part of the chain 27 to stabilize it. The casing 30 is provided on the left in FIG. 3 with a passage for the bases 211 of the shelves 21, but forms a depot for their rollers 213. The right-hand wall 32 of the casing 30 forms a track for the rollers 214. The casing 30 thus serves to keep the loaded shelves 21 parallel.

The embodiment described above with reference to FIGS. 2 and 3 of the drawings is symmetrical. The same designations are therefore used in the lefthand half of the configuration but supplied with a prim.

However, it should be evident that the embodiment shown in FIGS. 2 and 3 constitutes only a currently preferred embodiment of the apparatus for performing the method according to the invention. Many other embodiments of the apparatus are, however, feasible within the scope of the appended claims.

In the preferred embodiment, the lefthand series 20' of shelves is considered as a component in the equipment used to transfer sections 1 between the righthand series and the conveyor. However, one skilled in the art will perceive many other possibilities of performing the method according to the invention.

I claim:

1. Apparatus for temporarily storing a succession of flexible flat objects which have been arranged in overlapping formation, the apparatus comprising means for dividing a succession of the objects into separate sections of the succession; a temporary store for the separate sections; a conveyor for transporting the separate sections from the dividing means through the temporary store, the conveyor having lateral sides;

transfer means for transferring the separated sections into a series of vertical layers in the store, the transfer means comprising a first set of shelves arrayed vertically above one another at one of the lateral sides of the conveyor and second set of shelves arranged one above the other at the opposite lateral side of the conveyor, the shelves in each of the first and second sets being arranged so that a respective pair of shelves, one from each of the first and second sets, is adapted for supporting opposite lateral edge regions of a section of the flexible objects;

the transfer means further including apparatus for moving each of the sets of shelves up past the conveyor and transversely to the direction of motion of the conveyor, for causing a respective pair of the shelves to raise a respective section that is then on the conveyor and is then between the shelves of the conveyor off the conveyor and onto the shelves of the pair and into the store;

the conveyor includes a support surface for a section of flexible objects and the support surface moves through the store; the transfer means for moving the shelves is so connected with the shelves as to increase the lateral distance, as measured across the conveyor, between the respective shelves of each pair of shelves for increasing the space between those shelves in the region just below and also in the region just above the support surface of the conveyor.

2. The apparatus of claim 1, wherein the transfer means are connected with the two series of shelves for moving the two series of shelves in synchronism to move a respective pair of the shelves for a respective section of flexible objects for raising the section of flexible objects from the conveyor.

3. The apparatus of claim 2, wherein the shelves in their respective first and second sets are so located at the lateral sides of the conveyor and the transfer means so move the sets of the shelves with respect to the conveyor that the shelves form skid rails for the lateral edge regions of the sections as a respective section is moved by the conveyor into the store and before the transfer means moves the respective pair of the shelves that have served as skid rails transversely to the conveyor for raising the respective section of flexible objects off the conveyor.

4. Apparatus for temporarily storing a succession of flexible flat objects which have been arranged in overlapping formation, the apparatus comprising means for dividing a succession of the objects into separate sections of the succession; a temporary store for the separate sections; a conveyor for transporting the separate sections from the dividing means through the temporary store, the conveyor having lateral sides;

transfer means for transferring the separated sections into a series of vertical layers in the store, the transfer means comprising a first set of shelves arrayed vertically above one another at one of the lateral sides of the conveyor and second set of shelves arranged one above the other at the opposite lateral side of the conveyor, the shelves in each of the first and second sets being arranged so that a respective pair of shelves, one from each of the first and second sets, is adapted for supporting opposite lateral edge regions of a section of the flexible objects;

the transfer means further including apparatus for moving each of the sets of shelves up past the conveyor and transversely to the direction of motion of the conveyor, for causing a respective pair of the shelves to raise a respective section that is then on the conveyor and is then between the shelves of the conveyor off the conveyor and onto the shelves of the pair and into the store;

the transfer means are connected with the two series of shelves for moving the two series of shelves in synchronism to move a respective pair of the shelves for a respective section of flexible objects for raising the section of flexible objects from the conveyor;

the shelves of a respective pair are adapted for supporting the lateral edge regions of a section of flexible objects; the transfer means being adapted to move the shelves in each set thereof vertically upwardly with the edge regions of a section of flexible objects being supported on a respective pair of the shelves, and the transfer means further including means for inclining each shelf obliquely upwardly in the direction toward the other shelf of the pair while the shelves are being moved up by the transfer means and when the shelves are above the conveyor;

each shelf extending far enough toward the other shelf of the respective pair that the side edge regions of the respective flexible section supported on the shelf pair fold downwardly over the respective shelves of the pair for stiffening the section of flexible articles, thereby to prevent the section from flexing sufficiently as to fall between the shelves of the pair.

5. The apparatus of claim 4, wherein the conveyor includes a support surface for a section of flexible objects and the support surface moves through the store; the transfer means for both sets of shelves moving the shelves of the respective pair of shelves that is then moving past the support surface of the conveyor on which a section of flexible objects is supported with the shelves of the pair being generally parallel to each other, while above the support surface, the inclining means causes the shelves to incline upwardly, for causing the bending of the edge regions of the section of flexible objects for stiffening them.

6. The apparatus of claim 5, wherein the transfer means includes a respective roll for each set of shelves and located below the support surface of the conveyor; each set of shelves including an endless band along which the shelves are vertically spaced and the respective rolls being placed as to cause the space between the shelves of a pair to be greater below than at the level of the surface of the conveyor.

7. The apparatus of claim 5, wherein the transfer means is so connected with the shelves as to increase the lateral distance, as measured across the conveyor, between the respective shelves of each pair of shelves for increasing the space between those shelves in the region just below the conveyor support surface.

* * * * *